US005448061A

United States Patent [19]

Wells

[11] Patent Number: 5,448,061

[45] Date of Patent: Sep. 5, 1995

[54] METHOD OF SPACE CHARGE CONTROL FOR IMPROVED ION ISOLATION IN AN ION TRAP MASS SPECTROMETER BY DYNAMICALLY ADAPTIVE SAMPLING

[75] Inventor: Gregory J. Wells, Fairfield, Calif.

[73] Assignee: Varian Associates, Inc., Palo Alto, Calif.

[21] Appl. No.: 178,698

[22] Filed: Jan. 10, 1994

Related U.S. Application Data

[63] Continuation-in-part of Ser. No. 68,453, May 27, 1993, Pat. No. 5,397,894, and Ser. No. 43,240, Apr. 6, 1993, Pat. No. 5,381,006, which is a continuation-in-part of Ser. No. 890,991, May 29, 1992, abandoned.

[51] Int. Cl.[6] ..... H01J 49/42

[52] U.S. Cl. ..... 250/282; 250/283; 250/292; 250/252.1

[58] Field of Search ..... 250/282, 283, 290, 291, 250/292, 252.1

[56] References Cited

U.S. PATENT DOCUMENTS

| | | | |
|---|---|---|---|
| Re. 34,000 | 7/1992 | Syka et al. | 250/282 |
| 4,771,172 | 9/1988 | Weber-Grabau et al. | 250/282 |
| 5,198,665 | 3/1993 | Wells | 250/282 |
| 5,381,006 | 1/1995 | Wells et al. | 250/282 |
| 5,397,894 | 3/1995 | Wells et al. | 250/282 |

*Primary Examiner*—Jack I. Berman
*Assistant Examiner*—James Beyer
*Attorney, Agent, or Firm*—David Schnapf; Edward H. Berkowitz

[57] ABSTRACT

A method of using a quadrupole ion trap mass spectrometer for high resolution mass spectroscopy is disclosed. In the preferred embodiment, the space charge in the ion trap is controlled to high accuracy. This is done by using a prescan of the trap before each analytical scan, where the ionization parameters used in the prescan are not fixed, but rather are based on the previous analytical scan. The method is especially useful in connection with performance of high resolution MS/MS experiments of the type described in the inventor's prior U.S. Pat. No. 5,198,665.

23 Claims, 5 Drawing Sheets

METHOD OF SPACE CHARGE CONTROL FOR IMPROVED ION ISOLATION IN AN ION TRAP MASS SPECTROMETER BY DYNAMICALLY ADAPTIVE SAMPLING

RELATED CASES

This case is a continuation-in-part of Ser. No. 08/043,240, filed Apr. 6, 1993 now U.S. Pat. No. 5,381,006, which was a continuation-in-part of Ser. No. 07/890,991, May 29, 1992 now abandoned. This case is also a continuation-in-part of Ser. No. 08/068,453, filed May 27, 1993 now U.S. Pat. No. 5,397,894.

FIELD OF THE INVENTION

The present invention relates to the field of mass spectrometry, and is particularly related to methods for controlling space charge effects in a three-dimensional quadrupole ion trap mass spectrometer for improved ion isolation and mass resolution.

BACKGROUND OF THE INVENTION

The present invention relates to methods of using the three-dimensional quadrupole ion trap mass spectrometer ("ion trap") which was initially patented in 1960 by Paul, et al., (U.S. Pat. No. 2,939,952). In recent years use of the ion trap mass spectrometer has grown dramatically, in part due to its relatively low cost, ease of manufacture, and its unique ability to store ions over a large range of masses for relatively long periods of time. This latter feature makes the ion trap especially useful in isolating and manipulating individual ion species, as in a so-called tandem MS or "MS/MS" experiment where a "parent" ion species is isolated and fragmented or dissociated to create "daughter" ions which may then be identified using traditional ion trap detection methods or further fragmented to create granddaughter ions, etc. Nonetheless, there is a need to improve high mass resolution and reproducibility of results in ion traps. A major factor limiting the mass resolution and reproducibility is space charge which can alter the trapping conditions from one experiment to the next unless held at a constant level.

The quadrupole ion trap comprises a ring-shaped electrode and two end cap electrodes. Ideally, both the ring electrode and the end cap electrodes have hyperbolic surfaces that are coaxially aligned and symmetrically spaced. By placing a combination of AC and DC voltages (conventionally designated "V" and "U", respectively) on these electrodes, a quadrupole trapping field is created. A trapping field may be simply created by applying a fixed frequency (conventionally designated "f") AC voltage between the ring electrode and the end caps to create a quadrupole trapping field. The use of an additional DC voltage is optional, and in commercial embodiments of the ion trap no DC voltage is normally used. It is well known that by using an AC voltage of proper frequency and amplitude, a wide range of masses can be simultaneously trapped.

The mathematics of the quadrupole trapping field created by the ion trap are well known and were described in the original Paul, et al., patent. For a trap having a ring electrode of a given equatorial radius $r_0$, with end cap electrodes displaced from the origin at the center of the trap along the axial line $r=0$ by a distance $z_0$, and for given values of U, V and f, whether an ion of mass-to-charge ratio (m/e, also frequently designated m/z) will be trapped depends on the solution to the following two equations:

$$a_z = \frac{-16eU}{m(r_0^2 + 2z_0^2)\omega^2} \quad \text{Eq. 1}$$

$$q_z = \frac{+8eV}{m(r_0^2 + 2z_0^2)\omega^2} \quad \text{Eq. 2}$$

where $\omega$ is equal to 2 #f.

Solving these equations yields values of $a_z$ and $q_z$ for a given ion species having the selected m/e. If the point $(a_z,q_z)$ maps inside the stability envelop, the ion will be trapped by the quadrupole field. If the point $(a_z,q_z)$ falls outside the stability envelop, the ion will not be trapped and any such ions that are introduced within the ion trap will quickly move out of the trap. By changing the values of U, V or f one can affect the stability of a particular ion species. Note that from Eq. 1, when $U=0$, (i.e., when no DC voltage is applied to the trap), $a_z=0$.

(It is common in the field to speak in abbreviated fashion in terms of the "mass" of ions, although it would be more precise to speak of the mass-to-charge ratio of ions, which is since that is what really affects the behavior of an ion is a trapping field. For convenience, this specification adopts the common practice, and generally uses the term "mass" as shorthand to mean mass-to-charge ratio.)

The typical method of using an ion trap consists of applying voltages to the trap electrodes to establish a trapping field which will retain ions over a wide mass range, introducing a sample into the ion trap, ionizing the sample, and then scanning the contents of the trap so that the ions stored in the trap are ejected and detected in order of increasing mass. Typically, ions are ejected through perforations in one of the end cap electrodes and are detected with an electron multiplier.

A number of methods exist for ionizing sample molecules. Most commonly, sample molecules are introduced into the trap and an electron beam is turned on, ionizing the sample within the trap volume. This is referred to as electron impact ionization or "EI". Alternatively, ions of a reagent compound can be created within or introduced into the ion trap to cause ionization of the sample due to interactions between the reagent ions and sample molecules. This technique is referred to as chemical ionization or "CI". Other methods of ionizing the sample, such as photoionization using a laser beam or other light source, are also known. For purposes of the present invention the specific ionization technique used to create ions is generally not important.

The various known ionization techniques all involve what will be referred to as "ionization parameters" that effect the number of ions created or introduced into the ion trap. In turn, the number of ions stored within the trap volume determines the space charge within the trap, since the space charge in the trap is a function of the overall ion population. Various ionization parameters may be used to control the number of ions introduced in the trap depending on the specific method of ion introduction. For example, when using EI, the number of ions created in the trap is a function of the intensity of the electron beam used to create the ions as well as the length of time the beam is turned on. Thus, both of these are ionization parameters as that term is used in the present specification, since the ion population in the trap can be controlled by varying the intensity of the beam or by varying the length of time the beam is turned on. Likewise, when using photoionization, both the length of time the light beam is turned on and the intensity of the beam are considered ionization parameters.

When using CI, the reaction time between the sample molecules and the reagent ions is an ionization parameter. It is noted that reagent ions are normally created within the ion trap by ionizing reagent molecules using an electron beam. In other words, the reagent ions are normally created by EI. In such a situation, the quantity of reagent ions created in the ion trap is dependent on the same ionization parameters described above, i.e., the length of time the electron beam is turned on and the intensity of the beam. When ionizing reagent ions, measures are normally taken to eliminate any sample ions simultaneously formed in the ion trap. According to the present invention, another method of creating reagent ions for a CI experiment is to allow initial precursor ions to react with a reagent gas to form the desired reagent ions. Thus, the reagent ions are themselves formed by chemical ionization.

While in most instances sample ions are created within the trap volume, in some instances ions may be created externally by any of the foregoing methods and transported into the ion trap using known ion transport means. In such instances, an electronic gating arrangement may be used to control the flow of ions into the trap, and the length of time the ion gate is "open" can be used to control the ion population introduced into the ion trap. Thus, this would also be considered an ionization parameter according to the present invention.

As described, there are a number of known methods for creating the ions that are trapped in an ion trap. For purposes of this specification, the terms "introduced" and "introducing," when used in connection with sample ions, are intended to cover all of the various methods. Thus, ions may be introduced into the ion trap either by formation within the trap volume, as by traditional in-trap EI or CI techniques, or by formation outside of the ion trap and transport into the trap volume.

Once the ions are formed and stored in the trap a number of techniques are available for isolating specific ions of interest, and for conducting so-called MS/MS experiments, sometimes called $(MS)^n$ experiments. As noted, in MS/MS experiments an isolated ion or group of ions, called "parent" ions, are fragmented creating "daughter" ions, which may be detected themselves or fragmented to create "granddaughter" ions, etc. Techniques for isolating parent, daughter, etc., ions in an ion trap involve manipulating the trapping voltage(s) and/or using supplemental voltages as described in greater detail below. One particularly useful method of isolating an individual ion species in an ion trap is described in U.S. Pat. No. 5,198,665 (the '665 patent) issued to the present inventor and coassigned herewith. The disclosure of the '665 patent is hereby incorporated by reference.

Obtaining a mass spectrum generally involves scanning the trap so that ions are removed from the ion trap and detected. U.S. Pat. No. 4,540,884 to Stafford, et al., describes a technique for scanning one or more of the basic trapping parameters of the quadrupole trapping field, i.e., U, V or f, to sequentially cause trapped ions to become unstable and leave the trap. Unstable ions tend to leave in the axial direction and can be detected using a number of techniques, for example, as mentioned above, a electron multiplier or Faraday collector connected to standard electronic amplifier circuitry.

In the preferred method taught by the '884 patent, the DC voltage, U, is set at 0. As noted, from Eq. 1 when $U=0$, then $a_z=0$ for all mass values. As can be seen from Eq. 2, the value of $q_z$ is directly proportional to V and inversely proportional to the mass of the particle. Likewise, the higher the value of V the higher the value of $q_z$. In the preferred embodiment the scanning technique of the '884 patent is implemented by ramping the value of V. As V is increased positively, the value of $q_z$ for a particular mass increases to the point where it passes from a region of stability to one of instability. Consequently, the trajectories of ions of increasing mass to charge ratio become unstable sequentially, and are detected when they exit the ion trap.

According to another known method of scanning the contents of an ion trap, a supplemental AC voltage is applied across the end caps of the trap to create an oscillating dipole field supplemental to the quadrupole field. (Sometimes this combination of a quadrupole trapping field and a supplemental rf dipole field is referred to as a "combined field.") In this method, the supplemental AC voltage has a different frequency than the primary AC voltage V. The supplemental AC voltage can cause trapped ions of specific mass to resonate at their so-called "secular" frequency in the axial direction. When the secular frequency of an ion equals the frequency of the supplemental voltage, energy is efficiently absorbed by the ion. When enough energy is coupled into the ions of a specific mass in this manner, they are ejected from the trap in the axial direction where they can be detected as has been described. The technique of using a supplemental dipole field to excite specific ion masses is sometimes called axial modulation. As is well known in the art, axial modulation is also frequently used to eject unwanted ions from the trap, and in connection with MS/MS experiments to cause parent ions in the trap to collide with molecules of a background buffer gas and fragment into daughter ions. This latter technique is commonly referred to as collision induced dissociation (CID). As is also well known, whether an ion will be ejected by axial modulation from the trap, or instead is merely fragmented, is largely dependent on the voltage level of the supplemental dipole voltage.

The secular frequency of an ion of a particular mass in an ion trap depends on the magnitude of the fundamental trapping voltage V. Thus, them are two ways of bringing ions of differing masses into resonance with the supplemental AC voltage: scanning the frequency of the supplemental voltage in a fixed trapping field, or varying the magnitude V of the trapping field while holding the frequency of the supplemental voltage constant. Typically, when using axial modulation to scan the contents of an ion trap, the frequency of the supplemental AC voltage is held constant and V is ramped so that ions of successively higher mass are brought into resonance and ejected. The advantage of ramping the value of V is that it is relatively simple to perform and provides better linearity than can be attained by changing the frequency of the supplemental voltage. The method of scanning the trap by using a supplemental voltage will be referred to as resonance ejection scanning.

Resonance ejection scanning of trapped ions provides better sensitivity than can be attained using the mass instability technique taught by the '884 patent and produces narrower, better defined peaks. In other words, this technique produces better overall mass resolution. Resonance ejection scanning also substantially increases the ability to analyze ions over a greater mass range.

In commercial embodiments of the ion trap using resonance ejection as a scanning technique, the frequency of the supplemental AC voltage is set at approximately one half of the frequency of the AC trapping voltage. It can be shown that the relationship of the frequency of the trapping voltage and the supplemental voltage determines the value of $q_z$ (as defined in Eq. 2 above) of ions that are at resonance. Indeed, sometimes the supplemental voltage is characterized in terms of the value of $q_z$ at which it operates.

While the most common method of analyzing the contents of an ion trap involves causing ions to sequentially leave the trap in the axial direction where they can be intercepted by an external detector, other detection methods, including in-trap detection methods are well known and may be used in connection with the present invention.

Commercially, most ion traps are sold in connection with gas chromatographs (GC's) which serve, essentially, as input filters to the ion traps. As is well known, a GC serves to separate a complex sample into its constituent compounds thereby facilitating the interpretation of mass spectra. Of course, ion trap technology is not limited to use with GC's, and other sample input sources are known. For example, with an appropriate interface, a liquid chromatograph can be used as a sample source. For some applications, no sample separation is required, and sample may be introduced directly into the ion trap.

The flow from a GC is continuous, and a modem high resolution GC produces narrow peaks, sometimes lasting only a matter of seconds. In order to obtain a mass spectra of narrow peaks, it is necessary to perform at least one complete scan of the ion trap per second. The need to perform rapid scanning of the trap adds constraints which may also affect mass resolution and reproducibility. Similar constraints exist when using the ion trap with an LC or other continuously flowing, variable sample stream.

As with most any instrument of its type, it is known that the dynamic range of an ion trap is limited, and that the most accurate and useful results are attained when the trap is filled with the optimal number of ions. Ion trap mass spectrometers are extremely susceptible to deleterious effects of space charge and ion molecule reactions. The space charge in the ion trap alters the overall trapping field, interfering with mass resolution and calibration. Moreover, space charge affects the trapping efficiency and ion molecular reactions. If too few ions are present in the trap, sensitivity is low and peaks may be overwhelmed by noise. If too many ions are present in the trap, space charge effects can significantly distort the trapping field, and peak resolution can suffer.

The prior art has addressed this problem by using a so-called automatic gain control (AGC) technique which aims to keep the total charge in the trap at a constant level. In particular, prior art AGC techniques use a fast "prescan" of the trap to estimate the charge present in the trap, and then uses this prescan to control a subsequent analytical scan. While this approach has been acceptable for many applications and experiments, the inventor has determined that it does not provide highly accurate control over the space charge in the ion trap and, thus, limits the ability to obtain very high resolution.

There is an increasing demand to provide equipment which overcomes these limitations and which is capable of providing very high resolution. This demand is especially present when performing MS/MS experiments. In such circumstances it is extremely important to control the total amount of space charge in the ion trap, as explained below.

There are several prior art AGC methods that have been used to control the space charge levels in ion traps so as to optimize the performance of the trap for various applications. These prior art methods all have in common a two-step process of conducting each sample analysis: performing a prescan to estimate the concentration of sample ions present in the trap using fixed, predetermined ionization parameters, followed by an analytical scan of the trap performed using optimized the ionization parameters, based on information obtained from the prescan. The goal of these techniques is to always store approximately the same total number of ions in the trap as the sample concentration levels change. As used herein the term prescan refers to a scan of the contents of the trap which is performed for the purpose of optimizing an ionization parameter. In a prescan, no mass spectrum for use by the spectroscopist is created. A prescan is normally performed so rapidly that meaningful mass spectral data would not be discernable due to the very poor mass resolution associated with rapid scanning. As used herein the term analytical scan refers to a scan intended to collect mass spectral data of the contents of the ion trap.

In the prior art method of Stafford, et al., (U.S. Pat. No. 5,107,109) the sample concentration in the trap is measured in a prescan by applying a short, fixed-duration electron beam to the trap to cause sample ionization, followed by a rapid measurement of the total ion content of the trap. This measurement is used to control the number of sample ions in the ion trap during the subsequent analytical scan. There is no teaching to rid the trap of any unwanted ions during either the prescan or the subsequent analytical scan.

In the prior art method of Weber-Grabau, et al., (U.S. Pat. No. 4,771,172) a fixed-duration prescan is again used, in a manner similar to the method of Stafford, et al., in conjunction with chemical ionization to measure the sample concentration in the trap prior to the analytical scan. This patent also teaches eliminating unwanted sample ions from the trap during the period in which reagent ions are created in the trap. As in Stafford, et al., both the length of time that the electron beam is turned on to ionize the reagent ions, as well as the length of time the reagent ions are allowed to react with the sample to ionize it, are fixed.

The prior art method of Kelley (U.S. Pat. No. 5,200,613) also discloses a prescan which uses a short, fixed ionization time as in the method of Stafford, et al., with the improvement being the additional step of applying notched-filtered noise to the trap to resonantly eject undesired ions. The ion ejection, by means of filtered noise, to isolate parent ions, is performed in connection with both the prescan and the analytical scan. Kelley also teaches use of this process with MS/MS experiments.

All of these prior art methods suffer from utilizing fixed, predetermined ionization parameters during the prescan step to estimate the sample concentration in the trap and to adjust an ionization parameter during the subsequent analytical scan. However, a variety of ion-molecule reactions can occur within the ion trap which alter the ion intensity of a particular ion of interest, such as the parent ion in a MS/MS experiment. These processes are functions of the level (or number) of ions that are in the trap, as well as the sample concentration level that is present. The use of a fixed ionizing condition for the prescan will produce a variable number of ions, depending on how much sample is present, relative to the matrix. As will be understood by those skilled in the art, the term "matrix" includes, e.g., those molecules eluting from the GC at any given which are different from the sample compound(s) of interest. Such background molecules may be present for a variety of reasons.

The method of the '109 patent has the additional limitation in that the prescan measures the integrated ion signal from a broad mass range of ions that are trapped during the ionization period of the prescan. In a complex matrix eluting from a GC the ratio of sample to matrix can change dramatically during the elution of a sample peak from the chromatograph. Fixed ionization conditions during the prescan may increase the error in the sample level determination by including undesired ions from the matrix. Ionization of the matrix will often produce large numbers of ions with masses below that of the parent ion. Low mass ions in particular are troublesome in an ion trap, because they decrease the trapping efficiency of the higher mass parent ions. When very high concentration levels of the matrix are present, use of a fixed prescan may cause the number of sample ions that are trapped to change with the level of the matrix, even if the sample level is constant.

The method of Kelley attempts to reduce the sample/matrix problem by improving upon the method of the '109 patent by adding the additional step of applying notched filtered noise to the trap during ionization to eject unwanted ions and to isolate the parent ion. This method has the limitation of applying the notched filtered noise field to the trap during the ionization period, when the RF trapping voltage is set at a relatively low level in order to trap a broad range of masses. At low RF trapping voltages the resonance line widths of adjacent high mass ions overlap so that even the narrow frequency notches disclosed in the Kelley patent, (e.g., 1 kHz), would trap ions over range of several masses. For example, a 12–15 mass unit range would fall within a 1 kHz frequency notch at mass 400. The same notched filtered noise is used to both eject unwanted ions during the ionization period and to isolate parent ions for subsequent dissociation in an MS/MS experiment. Used in this way, notched filtered noise is non-optimum for both ion ejection and ion isolation since they are done simultaneously. Moreover, because of the continuous frequency distribution of noise, large power levels are required in order to have enough power at the secular frequency of all unwanted ions in order to eject them completely. This will result in power broadening of the ion resonance. If the notch width is made smaller to improve the resolution of the ion isolation of the parent ion, the result will be a dramatic loss in parent ion storage. This is because the line width under the trapping conditions taught by Kelley is approximately 1.5 kHz, i.e., a given ion of interest will be resonated by all frequencies within a band of frequencies 1.5 kHz wide. Under these conditions high resolution trapping is not possible.

An alternate embodiment of the method of the Kelley patent applies to MS/MS processes wherein the prescan includes the step of parent ion dissociation to form daughter ions and the subsequent integration of the daughter ion signal as a means of determining the optimizing parameters for the analytical scan. A limitation in the use of daughter ions is that the formation of daughter ions and the reproducibility of the daughter ion spectra depends on, among other factors, parent ion level and the conversion efficiency from parent to daughter ions. Thus, one of the parameters that is most affected by changes in sample level and space charge levels in the trap is the one selected by Kelley to use in the determination of the ionization parameters for the analytical scan. Moreover, this is a particular problem when using a relatively short, fixed ionization period since the relative number of daughter ions that are produced will be low, such that minor variations could cause large variations in the calculated optimum ionization time.

The general limitations of the prior art techniques are: (1) the inability to isolate only the parent ion during a prescan; (2) the inability to selectively and reproducibly store only the parent ion at a constant level as the sample and matrix levels change during a prescan; (3) when using prescans with fixed ionization conditions, the space charge conditions of the prescan will change with the sample/matrix ratio, which will affect the mass calibration for a high resolution ion isolation step, such as described in the '665 patent, as well as the extent of undesired ion-molecule reactions that occur in the trap; and (4) the estimate of the sample concentration and the determination of the optimizing parameters will be in error, as the result of an inaccurate measure of the number of ions in the trap during the prescan.

SUMMARY OF THE INVENTION

Accordingly, it is an object of the present invention to provide a technique for using an ion trap to provide control space charge in the trap to a highly constant level.

Another object of the present invention is to provide a prescan technique which is adaptive so as to result in a highly uniform space charge of desired ion species in an ion trap.

Still another object of the present invention is to provide a method of performing MS/MS experiments in an ion trap in a manner that will produce highly uniform, reproducible results.

Yet another object of the present invention is to maintain a constant population of sample ions in an ion trap during multiple analytical scans notwithstanding changes in the sample/matrix ratio.

These and other objects of the present invention, which will be apparent to those of ordinary skill in the art upon reading the present specification in conjunction with the accompanying drawings and the appended claims, are realized in the present method for operating a quadrupole ion trap mass spectrometer. Generally, the method of the present invention involves use of a prescan which is adaptive, i.e., wherein the ionization parameters used during the prescan are not fixed but rather are based on a determination of the contents of the ion trap from a previous measurement. In one aspect, the method of the present invention involves establishing a trapping field in an ion trap, introducing sample ions into the ion trap, performing a prescan of the contents of the ion trap, adjusting an ionization parameter to optimize the number of ions in the ion trap, introducing more sample ions into the ion trap based upon the adjusted ionization parameter, performing an analytical scan of the ion trap, introducing more sample ions into the ion trap based upon said adjusted ionization parameter and, thereafter, performing a subsequent prescan of the contents of the ion trap for the next analytical experiment. In many applications, the step of introducing sample ions into the ion trap will simply involve subjecting sample molecules within the trap volume to a beam of electrons, and the ionization parameter that will be adjusted will be the length of time that the electron beam is on. The method of the present invention has particular application to performing MS/MS experiments where a desired ion species is isolated in the ion trap. In such cases, the preferred method, according to the present invention, of isolating a desired ion species in the ion trap with high resolution is to first scan low mass ions out of the ion trap using a supplemental dipole voltage applied to the end cap electrodes of the ion trap and scanning through the resonant frequencies of the low mass ions so that they are successively ejected by resonance ejection. Thereafter, a broadband supplemental voltage may be applied to the end cap electrodes to resonantly eject high mass ions from the ion trap. In one embodiment, the broadband voltage may include frequency gaps and the trapping voltage may be swept over a narrow range, or modulated. In the preferred embodiment, the step of isolating a desired mass within the ion trap is performed both in connection with the prescans and with the analytical scans. In an alternate method of performing MS/MS experiments according to the present invention, no prescan is performed and, instead, an ionization parameter for each analytical scan is determined from the previous analytical scan.

DETAILED DESCRIPTION

The present invention is directed to improving the mass resolution, signal-to-noise ratio and mass calibration accuracy of commercial quadrupole ion trap mass spectrometers so that they can be used for high mass resolution scanning. The quadrupole ion trap mass spectrometer (referred to herein as the "ion trap") is a well-known device which is both commercially and scientifically important. The general means of operation of the ion trap has been discussed above and need not be described in further detail as it is a well-established scientific tool which has been the subject of extensive literature. The preferred embodiment of the present invention involves repetitively scanning the trap, as is common in the art, especially when the ion trap is used with a GC. In each scan, a narrow mass range or ranges, covering the masses of sample ions of interest are isolated in the ion trap as described above.

Figure 1:
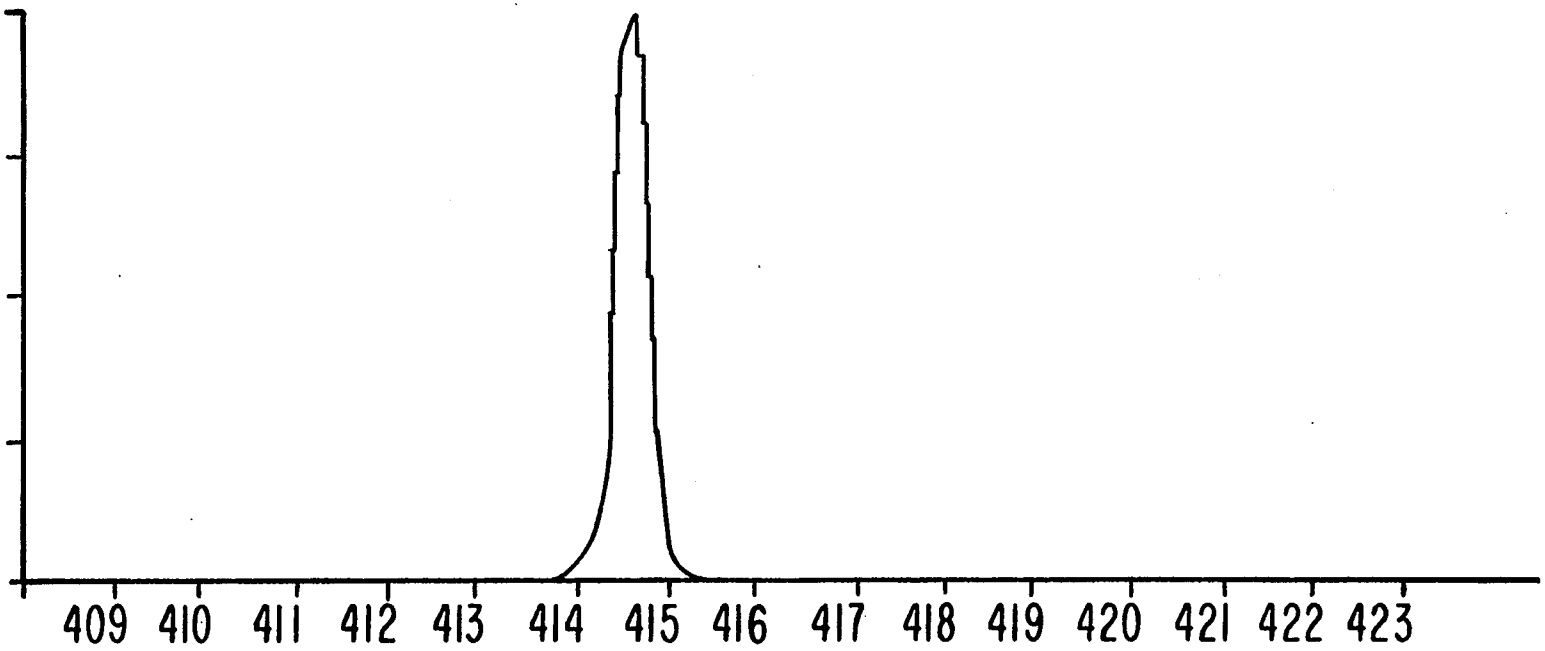
FIG. 1 is a mass spectra showing the isolation of a single mass from a sample of PFTBA.
Figure 2:
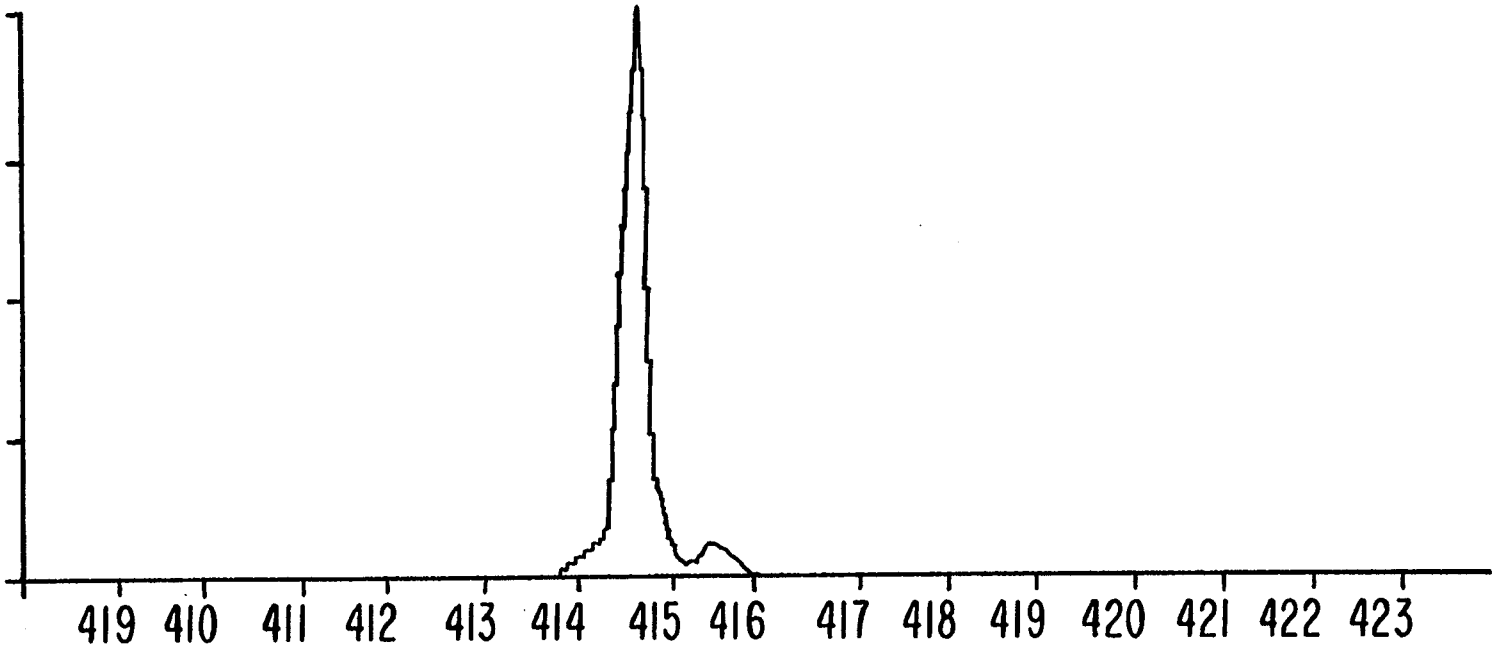
FIG. 2 is a mass spectra under the same conditions as FIG. 1 except that the space charge in the ion trap was substantially increased.

FIG. 1 shows the isolation of a single mass (m/z 414) of a sample of perfluorotributylamine (PFTBA) ionized using E1 and isolated using the method of the '665 patent. FIG. 2 shows the result of increasing the ion population in the trap by a factor of three. To increase the ion population in the experiment of FIG. 2, the ionization time has been increased by a factor of three. In both instances, a prescan was first performed using fixed ionization parameters. Due to the increased space charge within the trap it can be seen that the isolation of mass 414 has been affected, as evidenced by the appearance of mass 415. This is the result of the space charge shifting the secular frequency of the trapped ion so that it is no longer precisely in resonance with the applied supplemental broadband field used for high mass ejection. A similar effect occurs during the prescan when the sample concentration changes for a fixed prescan ionization time.

Figure 3:
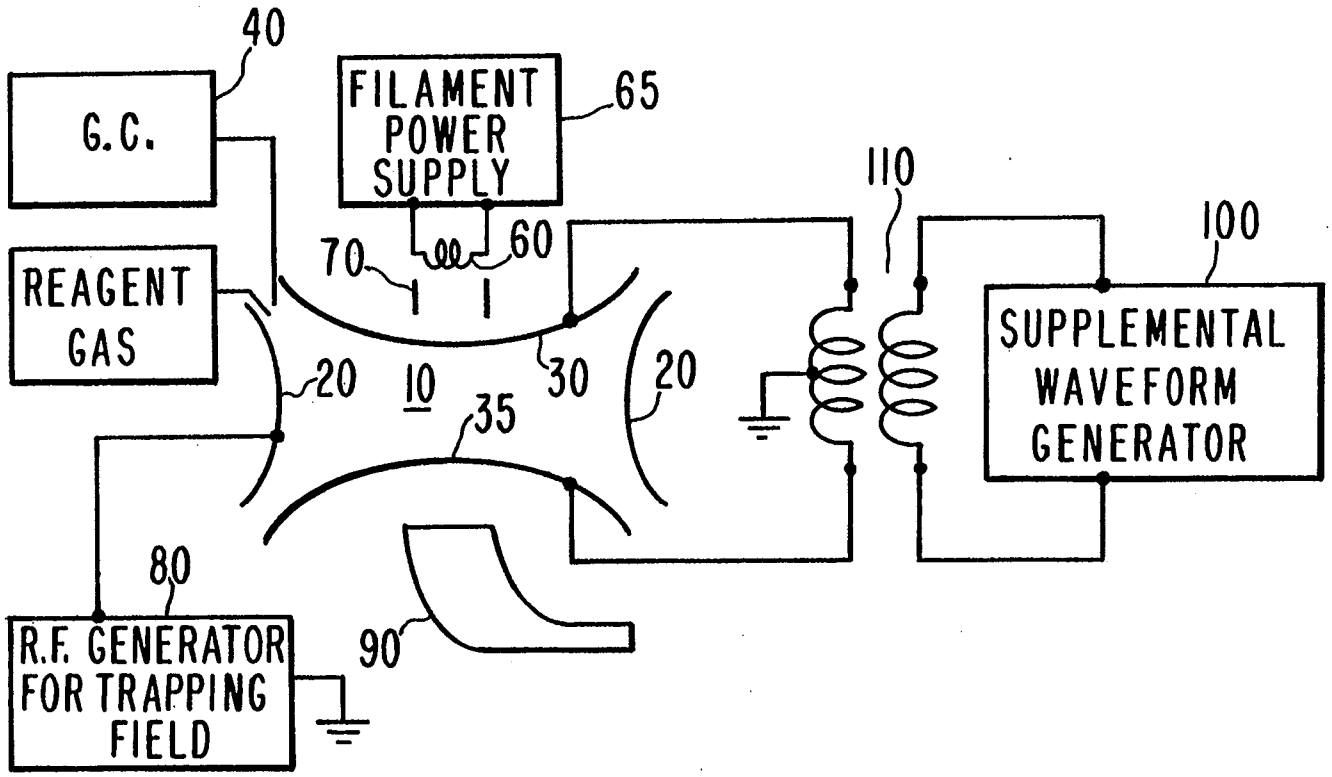
FIG. 3 is a schematic view of apparatus of the type which may be used in performing the method of the present invention.

Apparatus of the type which may be used in performing the method of the present invention is shown in FIG. 3, and is well known in the art. Ion trap 10, shown schematically in cross-section, comprises a ring electrode 20 coaxially aligned with upper and lower end cap electrodes 30 and 35, respectively. These electrodes define an interior trapping volume. Preferably, the trap electrodes have hyperbolic inner surfaces, although other shapes, for example, electrodes having a cross-sections forming an are of a circle, may also be used to create trapping fields. The design and construction of ion trap mass spectrometers is well-known to those skilled in the art and need not be described in detail. A commercial model ion trap of the type described herein is sold by the assignee hereof under the model designation Saturn.

Sample, for example from a gas chromatograph 40, is introduced into the ion trap 10. Since GCs typically operate at atmospheric pressure while ion traps operate at greatly reduced pressures, pressure reducing means (e.g., a vacuum pump, not shown) are required. Such pressure reducing means are conventional and well known to those skilled in the art. While the present invention is described using a GC as a sample source, the source of the sample is not considered a part of the invention and there is no intent to limit the invention to use with gas chromatographs. Other sample sources, such as, for example, liquid chromatographs with specialized interfaces, may also be used.

A source of reagent gas 50 may also be connected to the ion trap for conducting chemical ionization experiments. Sample and reagent gas that is introduced into the interior of ion trap 10 may be ionized by using a beam of electrons, such as from a thermionic filament 60 powered by filament power supply 65, and controlled by a gate electrode 70. The center of upper end cap electrode 30 is perforated (not shown) to allow the electron beam generated by filament 60 and control gate electrode 70 to enter the interior of the trap. The electron beam collides with sample and reagent molecules within the trap thereby ionizing them. Electron impact ionization of sample and reagent gases is also a well-known process that need not be described in greater detail. Of course, the method of the present invention is not limited to the use of electron beam ionization within the trap volume. Although not shown, more than one source of reagent gas may be connected to the ion trap to allow experiments using different reagent ions, or to use one reagent gas as a source of precursor ions to chemically ionize another reagent gas. In addition, a background gas may be introduced into the ion trap to dampen oscillations of trapped ions. Such a gas may also be used for CID, and preferably comprises a species, such as helium, with a high ionization potential above the energy of the electron beam or other ionizing source. When using an ion trap with a GC, helium is preferably used as the carrier gas.

A trapping field is created by the application of an AC voltage having a desired frequency and amplitude to stably trap ions within a desired range of masses. RF generator 80 is used to create this field, and is applied to the ring electrode. A DC voltage source (not shown) may be used to apply a DC component to the trapping field as is well known in the art.

The preferred method of scanning the trap involves use of a supplemental AC dipole voltage applied across end caps 30 and 35 of ion trap 10. Such a voltage may be created by a supplemental waveform generator 100, coupled to the end cap electrodes by transformer 110. The supplemental AC field is used to resonantly eject ions in the trap as described above. Each ion in the trap has a resonant frequency which is a function of its mass and of the trapping field parameters. When an ion is excited by a supplemental RF field at its resonant frequency it gains energy from the field and, if sufficient energy is coupled to the ion, its oscillations exceed the bounds of the trap, i.e., it is ejected from the trap. Ions which are ejected from the trap are detected by electron multiplier 90 or an equivalent detector. Alternatively, the technique of mass instability scanning (described above in connection with the '884 patent) may be used to determine the contents of the ion trap or methods based on the simultaneous ejection of contents of the trap by the application of a supplemental field as in a time-of-flight technique. It will be also recognized by those skilled in the art that in-trap detection methods, such as those described in Kelley, or involving measurement of induced currents may also be used for determining the contents of ion trap 10 after an experiment.

Supplemental waveform generator 100 is of the type which is capable of generating a broadband signal composed of a wide range of discrete frequency components. A broadband waveform created by generator 100 is applied to the end cap electrodes of the ion trap so as to simultaneously resonantly eject a broad range of ion masses from the trap. Supplemental waveform generator 100 may also be used to fragment parent ions in the trap by CID, as is well known in the art.

As previously described the method of '665 patent is capable of isolating a single ion in the trap with high resolution but suffers from the sensitivity of the mass calibration due to variable levels of space charge in the trap. Even though ions of only a single mass are present in the trap after isolation, the exact storage conditions (RF voltage) that will cause the applied supplemental frequency to resonate a particular mass, will depend on the space charge level of the ion that was isolated. Thus, mass calibration will be affected with the result that some of the desired parent ions will inadvertently be ejected, and the ejection of the adjacent masses will be incomplete. The daughter ion spectra will also depend on the amount of parent ion present in the trap due to variations in the amount of energy coupled into the parent ion motion during the collision induced dissociation step (CID). To remedy this situation, it is desirable to very precisely maintain a constant level of parent ion in the trap at all sample concentrations. This can be accomplished by utilizing prescan steps that adapt to changing conditions based on the ion level measured in the previous analytical scan of the isolated parent ion.

Figure 4:
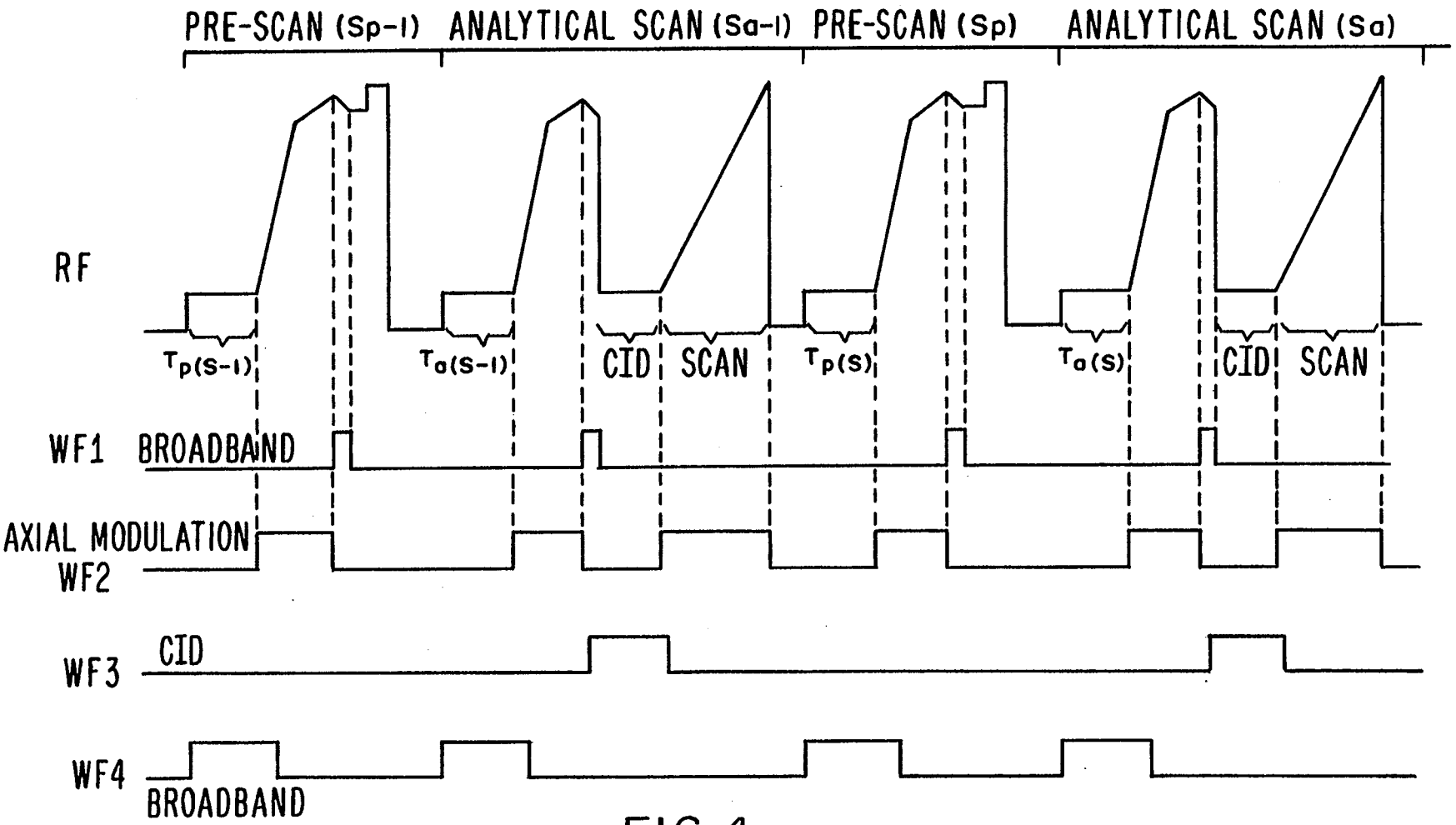
FIG. 4 is a timing diagram showing the steps of the method of the present invention.
Figure 5:
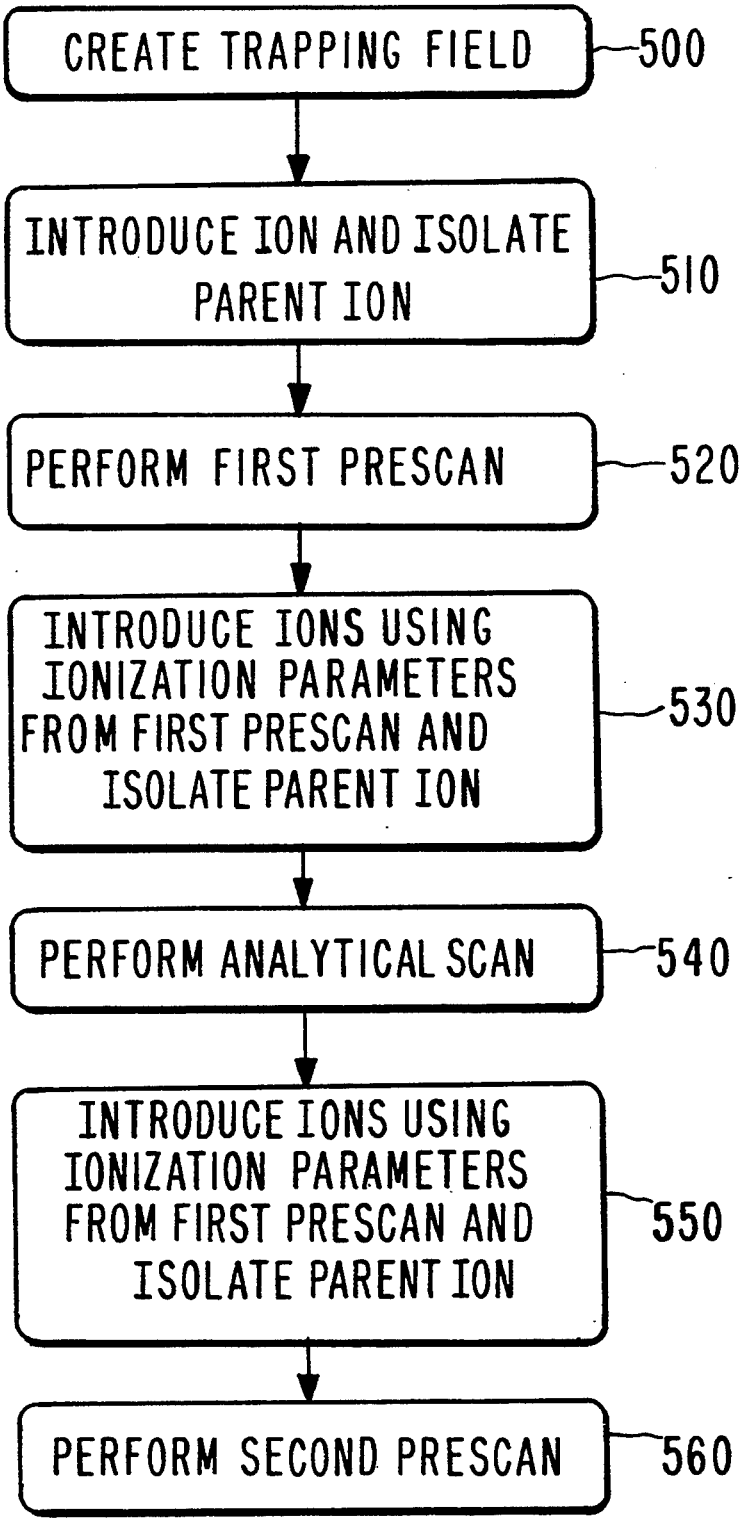
FIG. 5 is a flow chart showing the preferred embodiment of the method of the present invention.

The method is best illustrated by reference to FIGS. 4 and 5, to which we now turn. FIG. 4 is a timing diagram which shows the prescan ($S_p-1$) in which the ionization time is given by $T_{p(s-1)}$. A trapping field is created (500) and the ion of interest is isolated using the method of the '665 patent (510), and the resulting parent ion population level is measured by detecting the number of parent ions in the trap (520). Measurement of the parent ion population can be accomplished by raising the trapping RF level slightly above the value required to eject the ion either by resonant ejection, instability ejection or by applying a DC pulse to an end cap or any other of the well known methods of ion ejection or detection. Of course, methods of in-trap detection may also be utilized. After measuring the parent ion population in the first prescan the appropriate ionization parameters, such as ionization time, are calculated and used in the subsequent analytical scan (530). In FIG. 4 the ionization time for the analytical scan ($S_a-1$) is given as $T_{a(s-1)}$. Following the analytical scan (540), which also includes the isolation of the parent ion (530), the following prescan ($S_p$) (560) is performed using the ionization parameters that were calculated and used in the previous analytical scan, $T_{p(s)}=T_{a(s-1)}$ (550). Again, following the prescan ionization period the parent ion is isolated and the ion level measured by ejecting the ions for detection using an ionization time $T_{a(s)}$ calculated from the parent ion level measured in the prescan. These steps are repeated throughout the mass scanning process. The ionization times are thus: $T_{a(s)}=T_{p(s)}*X_a/I_{p(s)}$; where $X_a$ is a user defined "target" ion level and $I_{p(s)}$ is the measured parent ion level from the prescan, and $T_{p(s)}=X_p*T_{a(s-1)}$. The quantity $X_p$ is a user defined prescan target ion population and may be set equal to unity.

Adapting the prescan ionization parameters to the sample level, by using the previous analytical scan values, allows the parent ion level that is isolated in both the prescan and the analytical scan to be essentially the same constant value. Thus, the prescan is done under nearly identical conditions as the analytical scan so that space charge conditions are nearly identical. In this respect, the principal difference between the prescan and the analytical scan is that the prescan ejects the parent ions for detection, while the analytical scan adds the additional steps of dissociating the parent ions into daughter ions followed by a scan of the ions to determine the daughter ion spectrum.

In an alternative embodiment of the present invention, the prescan may be eliminated and the ionization parameters for each analytical scan may be based, instead, on information from the previous analytical scan. This, approach has the added advantage of saving time so that analytical scans may be performed more frequently.

In yet another embodiment of the method of the present invention two prescans are performed for each analytical scan. In this embodiment, the first prescan would use fixed, predetermined ionization parameters. A second prescan would then be performed using information from the first prescan to set adjusted ionization parameters to optimize the target ion population. This second prescan would then, in turn, be used to establish the ionization parameters for an analytical scan. The method of this alternative embodiment is useful in connection with performing highly accurate MS/MS experiments under circumstances where sample is not being repetitively analyzed, for example, if the sample source is not a GC or other continuously flowing source.

The preferred method of performing high resolution MS/MS according to the present invention is set out in the aforementioned U.S. Pat. No. 5,198,665, to the inventor hereof, which has been incorporated by reference. Briefly, according to the '665 patent, after ions are introduced into the ion trap, parent ions are isolated in an ion trap in a two-step process. First, unwanted low mass ions are ejected from the trap by scanned resonance ejection using a fixed-frequency supplemental rf dipole voltage applied to the end cap electrodes as described above. Thereafter, unwanted high mass ions are ejected from the ion trap using a broadband supplemental rf dipole voltage applied to the end cap electrodes. Preferably, after the broadband voltage is applied, the trapping voltage is reduced slightly so as to eliminate all ions above the mass of the parent ion. The broadband signal may be composed of a series of discrete frequency components and may include gaps between frequency components. The reduction of the trapping voltage effectively sweeps the resonant frequencies of the trapped ions. Other constructed or noise type broadband signals may also be used. It is noted that ion isolation in this manner has much higher mass resolution than the notched-filtered noise approach shown in the prescan step of the Kelley patent since the unwanted ions in mass proximity to the parent ion are ejected under much different trapping conditions. In an improvement on what is disclosed in the '665 patent, the low mass scanning may be conducted in two stages.

According to this improvement, most of the lower masses are rapidly scanned out of the ion trap; however, as the scan approaches the selected ion of interest, for example when the scan is within about 5 or 6 amu of the selected mass, the scan rate is slowed. The slowed rate may, for example, be the rate at which analytical scanning is normally performed. Likewise, the downscan of the broadband signal, which is used to eliminate higher mass ions from the ion trap, is preferably conducted in two similar stages, i.e., a rapid sweep followed by a slow scan as the signal approaches the resonant frequency of the selected ion. Preferably, the broadband signal continues to be applied for a short period of time (e.g., 3–5 ms) after the scan has been stopped.

While the preferred method of using the present invention in connection with MS/MS experiments uses the techniques of the '665 patent, other ways of isolating parent ions are known in the prior art and may be used.

The advantages of the invention over prior art are: (1) improved reproducibility of the concentration level of the isolated parent ions by using optimized ionization parameters determined by use of a prescan in which the parent ions were isolated prior to being detected; (2) the isolation of the parent ion at the same ion level and under substantially the same conditions for the prescan as is used for the analytical scan by using optimized ionization parameters for the prescan ionization that were determined from the previous prescan; (3) improved reproducibility of the daughter ion spectra as a result of dissociating the parent ions under conditions of substantially constant parent ion levels; (4) a method of space charge control of the parent ion level without the use of a prescan; and (5) improved trapping efficiency by ejecting the low mass ions below the parent ion by means of a broad band waveform applied to the trap.

While the present invention has been described in connection with the preferred embodiments thereof, those skilled in the art will recognize that other variations and equivalents to the subject matter described. Therefore, it is intended that the scope of the invention be limited only by the appended claims.

What is claimed is:

1. A method of using a quadrupole ion trap mass spectrometer comprising the steps of:

(a) establishing a trapping field within the ion trap such that ions in a range of interest are stably held within the ion trap;

(b) introducing sample ions into the ion trap;

(c) performing a prescan of the contents of the ion trap to establish a measurement indicative of the total number of ions in said trap;

(d) adjusting an ionization parameter in response to said measurement to optimize the number of ions in the ion trap during the subsequent analytical scan and again introducing sample ions into the ion trap based on the adjusted ionization parameter;

(e) performing an analytical scan of the contents of the ion trap;

(f) after step (e), yet again introducing sample ions into the ion trap based on said adjusted ionization parameter and performing another prescan of the contents of the ion trap.

2. The method of claim 1 wherein said sample ions are ionized within the ion trap.

3. The method of claim 2 wherein said sample ions are ionized using a beam of electrons.

4. The method of claim 3 wherein said ionization parameter is the length of time said electron beam is turned on.

5. The method of claim 1 further comprising the step of eliminating at least some unwanted ions from the ion trap prior to determining the contents of the ion trap during steps (c), (e) and (f).

6. The method of claim 5 wherein the step of eliminating at least some of the unwanted ions comprises isolating a single ion species in the ion trap.

7. The method of claim 6 wherein the step of isolating a single ion species in the ion trap comprises the steps of scanning the ion trap to eliminate low mass ions followed by the applying a broadband supplemental voltage to the ion trap to eliminate unwanted high mass ions.

8. The method of claim 7 wherein the step of scanning the ion trap to eliminate low mass ions comprises applying a supplemental voltage and sweeping the magnitude of said trapping field over the range of resonant frequencies of said low mass ions such that said low mass ions are resonantly ejected from the ion trap.

9. The method of claim 7 further comprising the steps of adjusting the magnitude of said trapping field while applying said broadband supplemental voltage.

10. The method of claim 9 wherein said broadband supplemental voltage has frequency gaps.

11. The method of claim 1 wherein said sample ions are ionized using chemical ionization.

12. The method of claim 11 wherein reagent ions are created within the trap by subjecting reagent molecules to an electron beam and wherein the ionization parameter that is adjusted is the length of time the reagent molecules are subjected to said electron beam.

13. The method of claim 11 wherein the ionization parameter that is adjusted is the length of time that reagent ions are allowed to react with sample molecules.

14. The method of claim 11 further comprising the step of isolating said reagent ions in the ion trap prior to chemical ionization of sample molecules.

15. A method of using a quadrupole ion trap mass spectrometer having a cylindrically symmetric quadrupole electrode defining an axis and a pair of oppositely facing end cap electrodes disposed on said axis, comprising the steps of:

(a) establishing a trapping field within the ion trap such that selected ion species in a range of interest are stably held within the ion trap;
(b) introducing sample ions into the ion trap;
(c) isolating a single ion species within the ion trap;
(d) performing a prescan of the contents of the ion trap and obtaining therefrom a measurement indicative of the total number of ions in said ion trap;
(e) in response to said measurement, adjusting an ionization parameter to optimize the number of ions of the selected ion species in the ion trap during a subsequent analytical scan of the contents of the ion trap and introducing sample ions into the ion trap based on the adjusted ionization parameter;
(f) isolating said single ion species in the ion trap;
(g) performing said analytical scan of the contents of the ion trap;
(h) reintroducing sample ions into the ion trap based on said adjusted ionization parameter;
(i) isolating said single ion species within the ion trap;
(j) performing another prescan of the contents of the ion trap.

16. The method of claim 15 wherein the steps of isolating said single ion species in the ion trap comprise applying a supplemental voltage to the end cap electrodes of the ion trap and scanning the ion trap to eliminate low mass ions by resonant ejection and thereafter applying a broadband supplemental voltage to the end cap electrodes of the ion trap to eliminate high mass ions by resonant ejection.

17. A method of using a quadrupole ion trap mass spectrometer comprising the steps of:

(a) establishing a trapping field within the ion trap such that ions in a range of interest are stably held within the ion trap;
(b) introducing sample ions into the ion trap;
(c) isolating a single ion species within the ion trap by applying a supplemental voltage to the end cap electrodes of the ion trap and scanning the ion trap to resonantly eject ions having a mass lower than the mass of the desired single ion species and thereafter applying a supplemental broadband voltage to the end cap electrodes of the ion trap to resonantly eject ions having a mass higher than the mass of the desired single ion species;
(d) scanning the contents of the ion trap;
(e) adjusting an ionization parameter to optimize the number of ions of said desired single ion species in a subsequent experiment based on the scan of step (d);
(f) introducing sample ions into the ion trap based on said adjusted ionization parameter; and,
(g) repeating steps (c) anti (d).

18. The method of claim 17 further wherein step (g) further comprises the step of conducting an MS/MS experiment after isolating the desired single ion species in the ion trap.

19. The method of claim 17 wherein said sample ions are introduced into the ion trap by exposing sample molecules within the ion trap to a beam of electrons and wherein said ionization parameter is the length of time said ion beam is turned on.

20. A method of using a quadrupole ion trap mass spectrometer comprising the steps of:

(a) establishing a trapping field within the ion trap such that ions in a range of interest are stably held within the ion trap;
(b) preforming a first prescan which includes the steps of introducing sample ions into the ion trap using fixed, predetermined ionization parameters;
(c) performing a second prescan which includes the steps of introducing sample ions into the ion trap using ionization parameters calculated on the basis of the first prescan; and,
(d) performing an analytical scan which includes the steps of introducing sample ions into the ion trap using ionization parameters calculated on the basis of the second prescan.

21. The method of claim 20 further comprising the step of isolating a parent ion during each prescan and said analytical scan.

22. A method of using a quadrupole ion trap mass spectrometer comprising the steps of:

(a) establishing a trapping field within the ion trap such that ions in a range of interest are stably held within the ion trap;
(b) isolating a parent ion of interest in the ion trap;
(c) performing a prescan using ionization parameters that are determined from an immediately prior scan of the ion trap, wherein said parent ion was isolated in the ion trap during said immediately prior scan; and,
(d) performing an analytical scan of the ion trap.

23. The method of claim 22 wherein said analytical scan comprises the step of performing an MS/MS experiment.

* * * * *